US007428946B2

(12) United States Patent
Honda et al.

(10) Patent No.: US 7,428,946 B2
(45) Date of Patent: Sep. 30, 2008

(54) SUSPENSION AND ELECTRO-ACOUSTIC TRANSDUCER USING THE SUSPENSION

(75) Inventors: Kazuki Honda, Mie (JP); Koji Sano, Mie (JP); Tatsuya Omori, Uji (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 178 days.

(21) Appl. No.: 10/523,694

(22) PCT Filed: Oct. 2, 2003

(86) PCT No.: PCT/JP03/12644

§ 371 (c)(1),
(2), (4) Date: Feb. 3, 2005

(87) PCT Pub. No.: WO2004/039124

PCT Pub. Date: May 6, 2004

(65) Prior Publication Data

US 2006/0162993 A1 Jul. 27, 2006

(30) Foreign Application Priority Data

Oct. 25, 2002 (JP) ..... 2002-310771

(51) Int. Cl.
*H04R 7/16* (2006.01)

(52) U.S. Cl. ..... 181/171; 181/163; 181/164; 181/165; 181/172; 181/173; 381/423; 381/425; 381/424; 381/398; 381/385; 381/386

(58) Field of Classification Search ..... 181/163, 181/164, 165, 171, 172, 173; 381/423, 425, 381/424, 398, 385, 386
See application file for complete search history.

(56) References Cited

U.S. PATENT DOCUMENTS 4,324,312 A 4/1982 Durbin
4,881,617 A * 11/1989 Faraone ..... 181/164
5,664,024 A * 9/1997 Furuta et al. ..... 381/412

(Continued)

FOREIGN PATENT DOCUMENTS

GB 393313 6/1933

(Continued)

OTHER PUBLICATIONS

Supplementary European Search Report issued Dec. 6, 2007 for EP Application No. 03753988.9, 3 pp.

*Primary Examiner*—Lincoln Donovan
*Assistant Examiner*—Jeremy Luks
(74) *Attorney, Agent, or Firm*—Wenderoth, Lind & Ponack, L.L.P.

(57) ABSTRACT

A suspension with a plurality of roll sections each of which has a semi-cylindrical shape from a cross-section view. The roll sections are disposed side by side based on a straight line connecting two points on an inner periphery or an outer periphery. The roll sections form a closed loop in a manner that a roll section of the roll sections being disposed first adjoins a roll section of the roll sections being disposed last. Adjacent roll sections are coupled with each other through a boundary section forming a continuous three dimensional curved surface. A linearity of compliance improves, and generation of distortion or rolling is restricted using the suspension.

14 Claims, 8 Drawing Sheets

U.S. PATENT DOCUMENTS

| | | | | |
|---|---|---|---|---|
| 5,880,412 | A * | 3/1999 | Faraone | 181/173 |
| 6,044,925 | A * | 4/2000 | Sahyoun | 181/157 |
| 6,160,898 | A * | 12/2000 | Bachmann et al. | 381/425 |
| 6,208,237 | B1 * | 3/2001 | Saiki et al. | 340/388.1 |
| 6,516,077 | B1 * | 2/2003 | Yamaguchi et al. | 381/424 |
| 6,697,496 | B2 * | 2/2004 | Frasl | 381/398 |
| 7,054,459 | B2 * | 5/2006 | Kuze et al. | 381/398 |
| 2002/0170773 | A1 * | 11/2002 | Stead et al. | 181/171 |
| 2003/0068064 | A1 * | 4/2003 | Czerwinski | 381/398 |
| 2003/0228027 | A1 * | 12/2003 | Czerwinski | 381/342 |

FOREIGN PATENT DOCUMENTS

| | | | |
|---|---|---|---|
| GB | 2348336 | | 9/2000 |
| JP | 57-34789 | | 2/1982 |
| JP | 05103395 | A * | 4/1993 |
| JP | 11205895 | A * | 7/1999 |
| JP | 2001-128284 | | 5/2001 |
| JP | 2002-95086 | | 3/2002 |
| WO | 03/009640 | | 1/2003 |

* cited by examiner

SUSPENSION AND ELECTRO-ACOUSTIC TRANSDUCER USING THE SUSPENSION

BACKGROUND OF THE INVENTION

1. Field of the Invention

The present invention relates to a suspension used in an apparatus for reproducing a sound such as a voice, music or a dial tone, and an electro-acoustic transducer using the same.

2. Description of the Related Art

A conventional electro-acoustic transducer is demonstrated hereinafter with reference to FIGS. 8, 9A and 9B. FIG. 8 is a sectional view of the electro-acoustic transducer. FIG. 9A is a plan view of a diaphragm. FIG. 9B is a sectional view of FIG. 9A taken along the line 9B-9B. In FIG. 8, diaphragm 6 generates aerial vibration. Diaphragm 6 is fixed to frame 11 by frame fixing part 4 through suspension 1 which has vibrating functions and supporting functions. Suspension 1 is of a semicylindrical shape in a cross section and uniform in a circumference direction. Diaphragm 6 is coupled with voice coil 10. Voice coil 10 is placed within magnetic gap 9 of magnetic circuit 8 which is provided at the middle of the frame 11 and formed of plate 13, magnet 14 and yoke 15.

Furthermore, protector 12, for protecting diaphragm 6, is bonded by using an adhesive. An operation of an electromotive loudspeaker structured as disclosed above is described hereinafter.

When a current flows in voice coil 10, the current crosses a magnetic field in magnetic gap 9 at right angles, and a driving force generated at voice coil 10 is transmitted to diaphragm 6. Then suspension 1 supports voice coil 10 in a manner that voice coil 10 becomes concentric with plate 13, and works as a spring in a vibrating direction when diaphragm 6 vibrates. When an alternating current (e.g., a voice signal) flows in voice coil 10, voice coil 10 and diaphragm 6 vibrate while being supported by suspension 1. As a result, air vibrates and a compressional wave is generated, so that a sound can be heard. For example, Japanese Patent Unexamined Publication (H5-103395) is known as a related art of this invention.

However, the conventional suspension has a uniform disk shape in a circumference direction and a closed structure. Therefore, as shown in an arbitrary point P of FIG. 5, which is a sectional view of the suspension in vibration and demonstrated later, when the suspension vibrates by $\Delta X$, a radius of point P changes by $\Delta r$, so that force is generated in a circumference direction.

This force is easy to be generated according as the suspension vibrates at large amplitude. As shown in line "A" of FIG. 4, which is a force-displacement characteristic and demonstrated later, compliance becomes non-linear at the large amplitude. Non-linearity of the compliance of supporting force, which is caused by a shape of suspension 1, causes distortion particularly in reproduction of a low tone area where amplitude becomes large.

Compliance of the suspension becomes difficult to maintain due to the phenomena discussed above, so that harmonic distortion is generated at sound pressure frequency characteristics. In addition, a deformation of the suspension is also induced, thereby causing a rolling phenomenon of the diaphragm.

SUMMARY OF THE INVENTION

A suspension includes a plurality of roll sections each of which has a semicylindrical shape in a cross section. The roll sections are disposed side by side based on a straight line connecting two points on an inner periphery or an outer periphery. The roll sections form a closed loop in a manner that a roll section of the roll sections being disposed first adjoins a roll section of the roll sections being disposed last. Adjacent roll sections are coupled with each other through a boundary section forming a continuous three dimensional curved surface.

DETAILED DESCRIPTION OF THE INVENTION

Exemplary embodiments of suspensions of the present invention are demonstrated hereinafter with reference to FIG. 1 through FIG. 7B. In the description, the same elements used in the background art have the same reference marks, and the descriptions of those elements are omitted here.

First Exemplary Embodiment

The first exemplary embodiment of the present invention is demonstrated hereinafter with reference to FIG. 1 through FIG. 5.

Figure 1A:
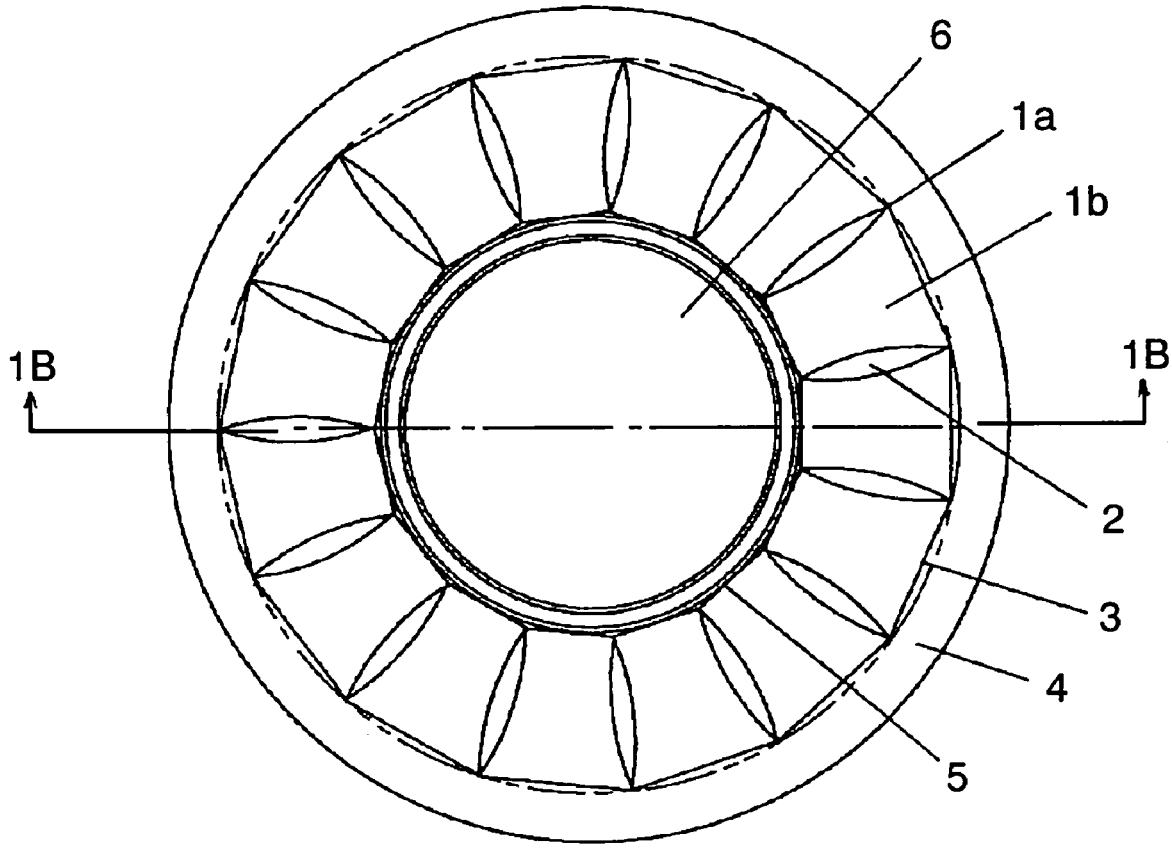
FIG. 1A is a plan view of a suspension in accordance with a first exemplary embodiment of the present invention.

FIG. 1A is a plan view of a suspension in accordance with the first exemplary embodiment of the present invention. FIG.

Figure 2A:
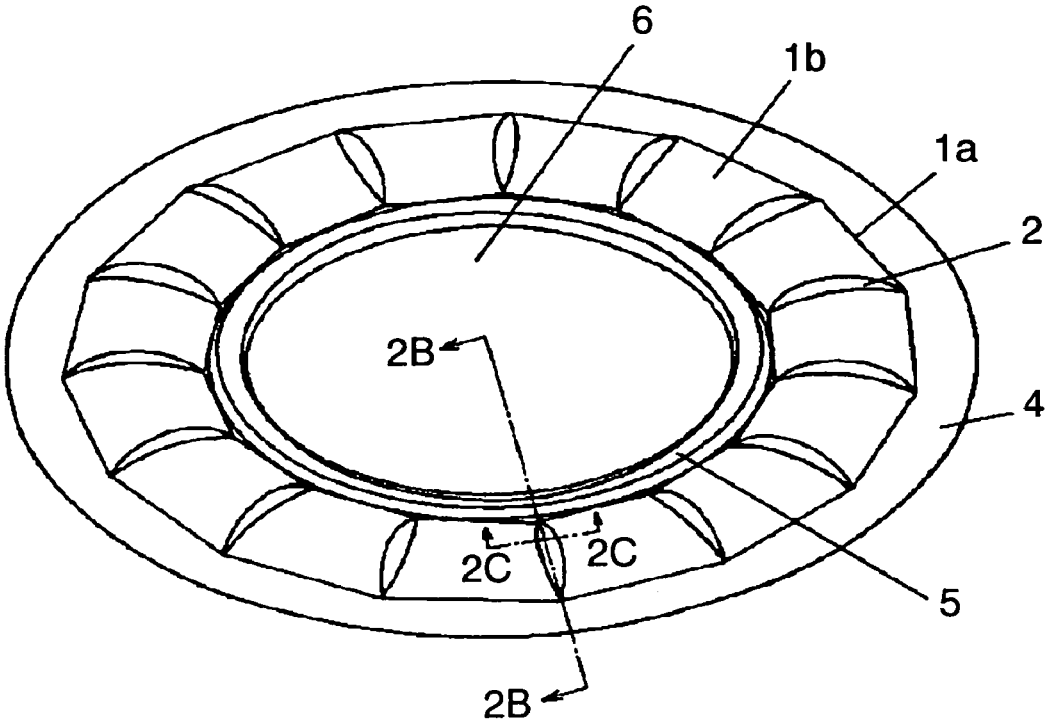
FIG. 2A is a perspective view of the suspension in accordance with the first exemplary embodiment of the present invention.
Figure 2B:
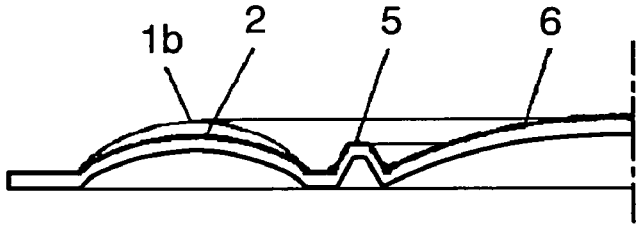
FIG. 2B is an enlarged sectional view of the suspension of FIG. 2A taken along the line 2B-2B in accordance with the first exemplary embodiment of the present invention.
Figure 2C:
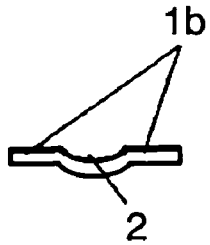
FIG. 2C is an enlarged sectional view of the suspension of FIG. 2A taken along the line 2C-2C in accordance with the first exemplary embodiment of the present invention.
Figure 3:
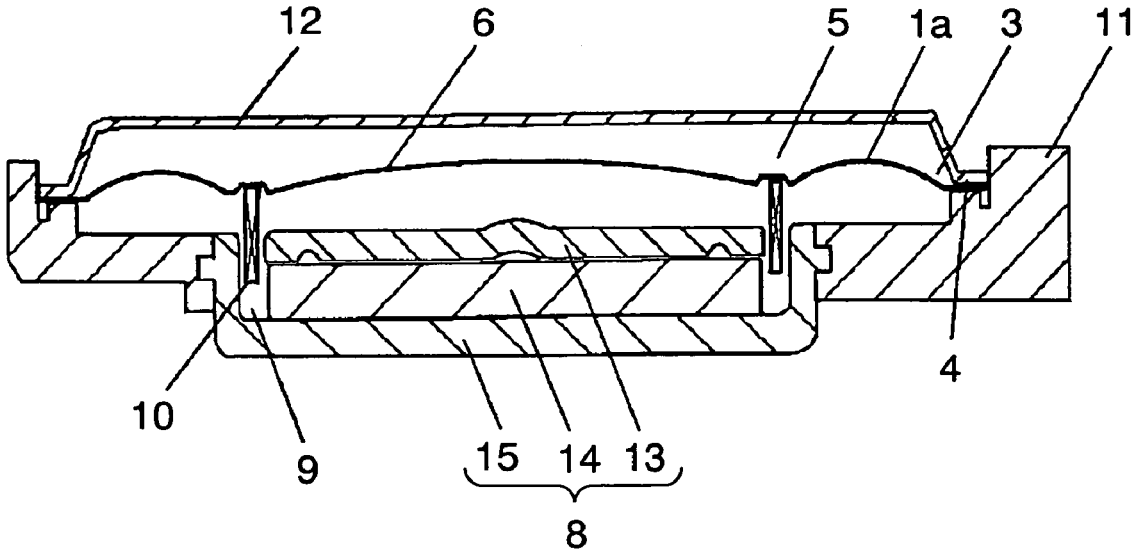
FIG. 3 is a sectional view of an electro-acoustic transducer using the suspension in accordance with the first exemplary embodiment of the present invention.
Figure 4:
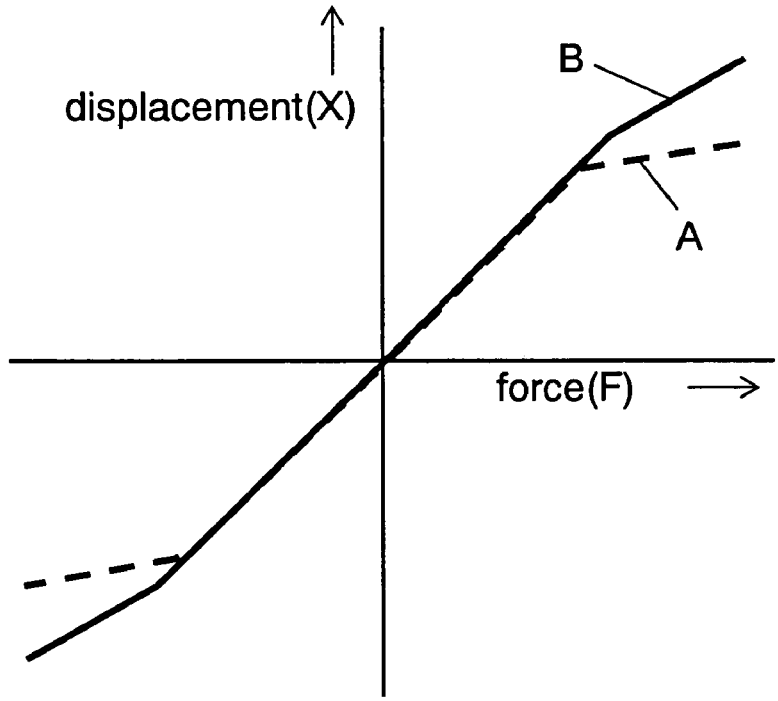
FIG. 4 is a graph showing a force-displacement characteristic of the suspension in vibration in accordance with the first exemplary embodiment of the present invention.
Figure 5:
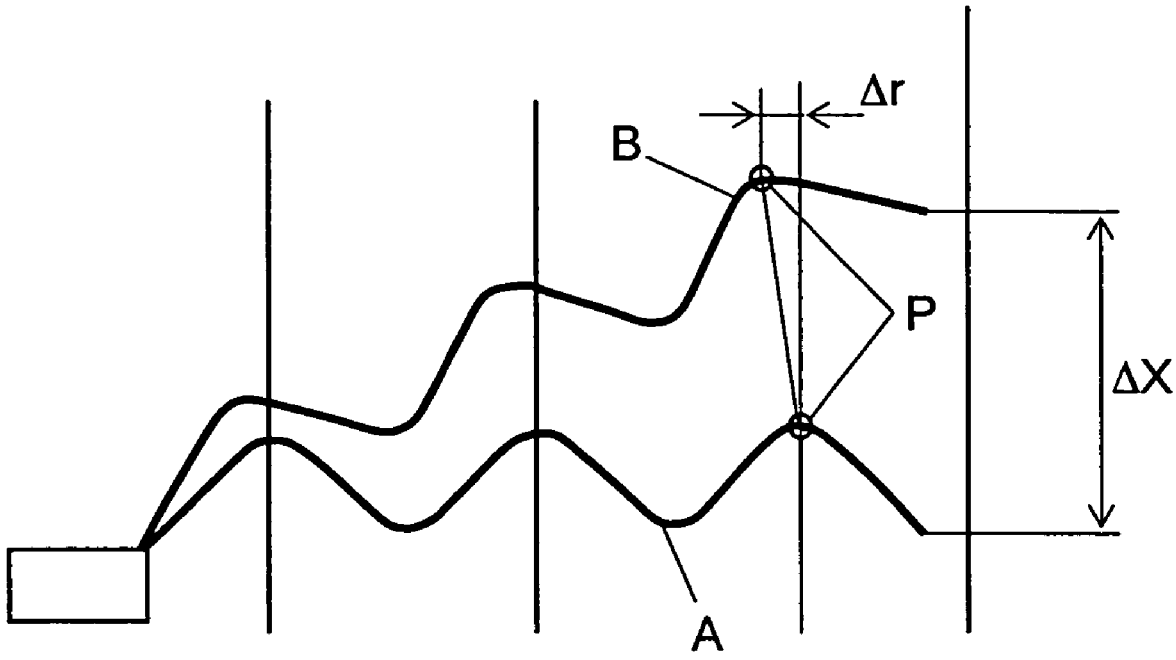
FIG. 5 shows a condition of the suspension in vibration in accordance with the first exemplary embodiment of the present invention.

1B is a sectional view of FIG. 1A taken along the line 1B-1B. FIG. 2A is a perspective view of FIG. 1A. FIG. 2B is an enlarged sectional view of FIG. 2A taken along the line 2B-2B. FIG. 2C is an enlarged sectional view of FIG. 2A taken along the line 2C-2C. FIG. 3 is a sectional view of an electro-acoustic transducer using the suspension. FIG. 4 is a graph showing a force-displacement characteristic of the suspension in vibration. FIG. 5 shows a condition of the suspension in vibration.

Figure 1B:
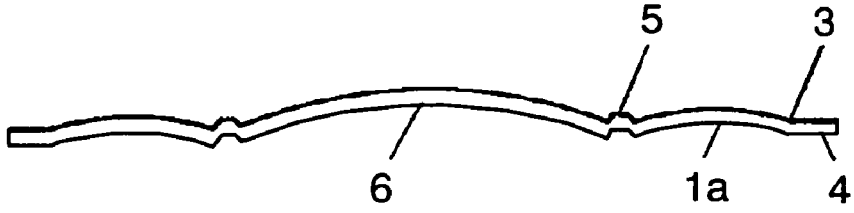
FIG. 1B is a sectional view of the suspension of FIG. 1A taken along the line 1B-1B in accordance with the first exemplary embodiment of the present invention.

In FIGS. 1A and 1B, roll sections 1*b* are disposed radially at a periphery of diaphragm 6 so as to form suspension 1*a*. Connecting part 3, which is linearly formed, is arranged between frame fixing part 4 and vibration system fixing part 5 is formed linear. Adjacent roll sections 1*b* are coupled with each other through boundary section 2 which forms a continuous three dimensional curved surface. Non-continuous parts of connecting parts 3 between frame fixing part 4 and vibration system fixing part 5 are trimmed, so that connecting parts 3 forms a closed loop. Because a plane of vibration is structured as a circle, an ellipse, or a polygon such as a quadrilateral or a rectangle in its plan view, roll section 1*b* is not limited in size or arrangement.

Figure 8:
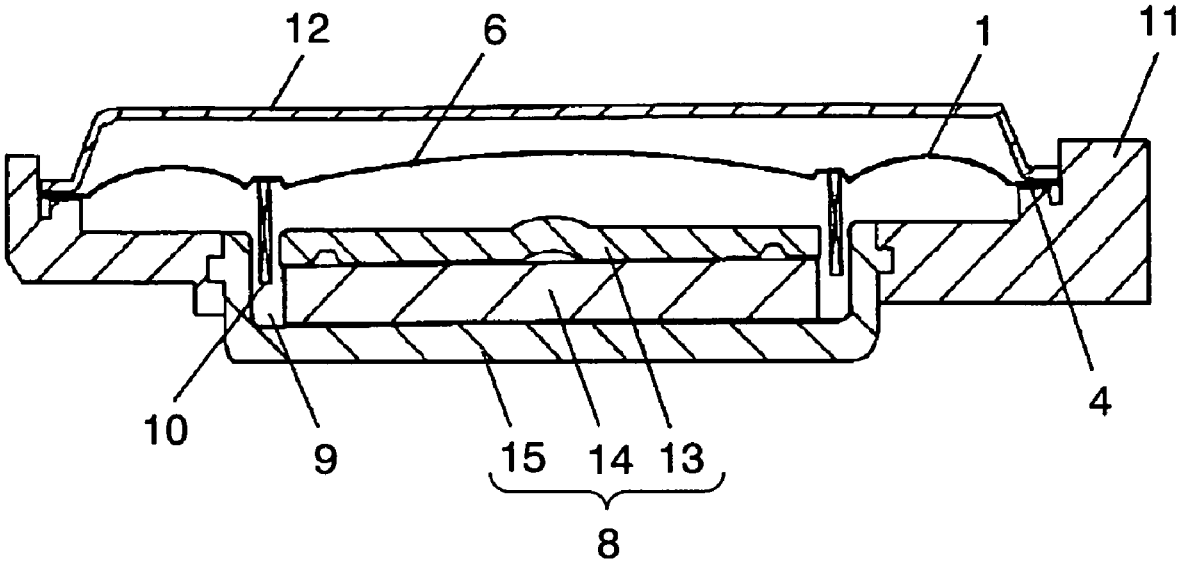
FIG. 8 is a sectional view of a conventional electro-acoustic transducer.
Figure 9A:
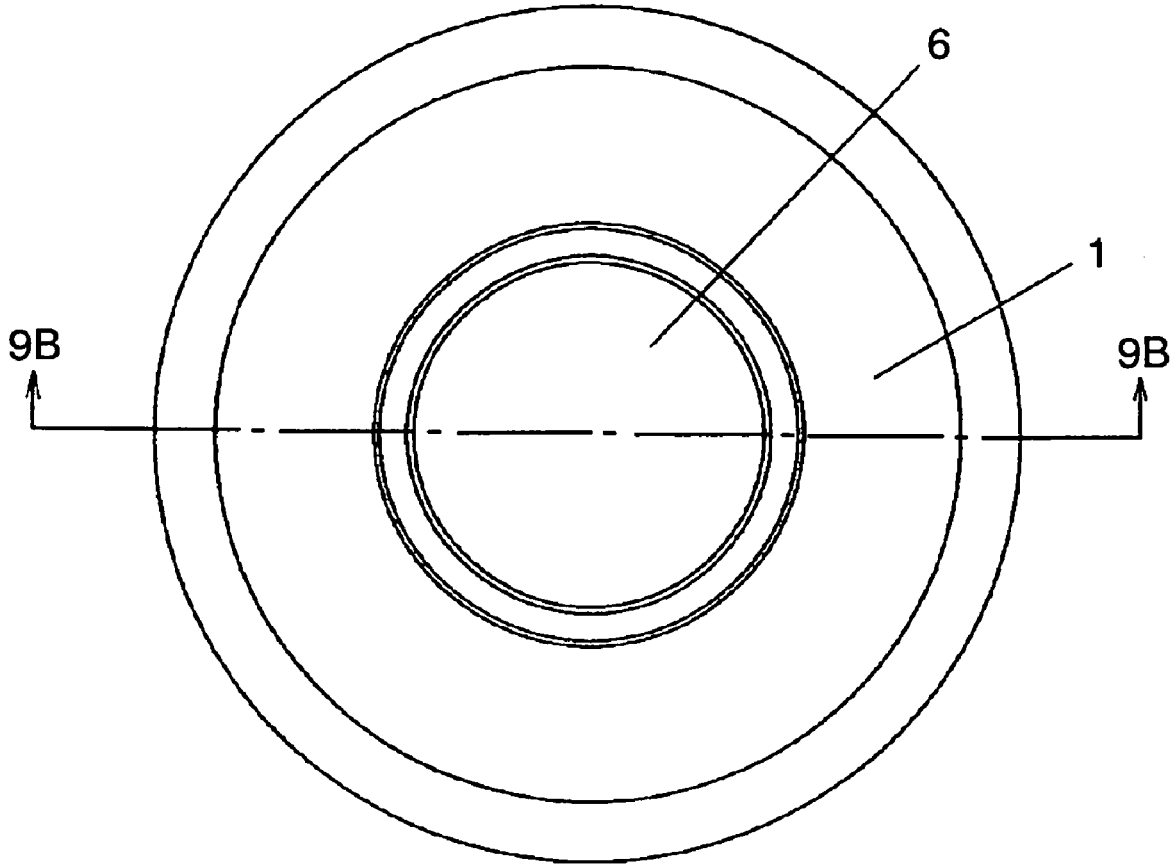
FIG. 9A is a plan view of a suspension which is an essential part of the conventional electro-acoustic transducer.
Figure 9B:
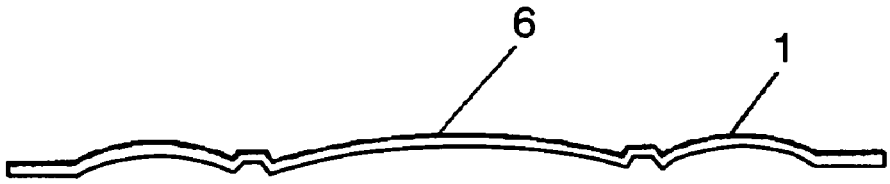
FIG. 9B is a sectional view of the suspension of the conventional electro-acoustic transducer of FIG. 9A taken along the line 9B-9B.

When each roll section 1*b* has the same shape, roll sections 1*b* are disposed at regular intervals, thereby forming a closed loop. Adjacent roll sections 1*b* are coupled with each other through boundary section 2 which forms a continuous three dimensional curved surface. Non-continuous parts of connecting parts 3 between frame fixing part 4 and vibration system fixing part 5 are trimmed, so that connecting parts 3 form a closed loop. Referring to FIG. 8, an outer periphery part of suspension 1*a* is fixed to frame 11 by frame fixing part 4, and an inner periphery part thereof is fixed to diaphragm 6 or voice coil 10 by vibration system fixing part 5.

Because connecting part 3 of roll section 1*b* is linear, force caused by the generation of Δr in FIG. 5 is not generated in lateral direction. Because of deformation of a semicylindrical shape of roll section 1*b* in vibration, boundary section 2 accommodates stress generated at a boundary between adjacent roll sections 1*b*. Therefore, as shown in "B" at large amplitude of the force-displacement characteristic of FIG. 4, a superior linearity of compliance can be obtained even at large amplitude, so that unnecessary resonance can be restricted. In addition, boundary section 2 covers a gap between roll sections 1*b*, so that dust can be prevented at magnetic gap 9.

Besides, a sectional shape of boundary section 2 between roll sections 1*b* is not limited to a semicylindrical shape shown in FIG. 2C.

The outer periphery part of the suspension is fixed to the roll sections forming a closed loop, and non-continuous parts are trimmed, so that the suspension is formed. Connection between the roll sections and the inner periphery part is trimmed, so that generation of distortion or the like is prevented.

In addition, frame fixing part 4, which is a connecting part between an outer linear portion of roll section 1*b* and frame 11, is trimmed to be formed as a continuous shape and fixed to frame 11.

Furthermore, vibration system fixing part 5, which is a connecting part between an inner linear portion of roll section 1*b* and diaphragm 6, is trimmed to be formed as a continuous shape and fixed to diaphragm 6 or voice coil 10.

According to the first exemplary embodiment, an odd number of roll sections 1*b* are described. Because the roll sections disposed at a periphery are formed asymmetric, generation of rolling in driving is prevented when the suspension is mounted in an electro-acoustic transducer.

Using the structure discussed above, amplitude becomes stable, so that deformation, which causes the rolling phenomenon, of suspension 1*a* can be prevented. As a result, distortion which affects acoustic characteristics can be reduced.

In addition, suspension 1*a* may be formed by heat-molding of a polymer resin film or thermoplastic elastomer film, or formed by injection-molding of resin. Using the method mentioned above, a complicated shape is easy to be formed, and suspension 1*a* can be integrally molded with diaphragm 6, so that the number of manufacturing processes can decrease.

Furthermore, suspension 1*a* may be formed by weaving vegetable fiber and/or chemical fiber, impregnating resin and press-molding. In addition, suspension 1*a* may be formed by heat-molding a sliced sheet of polyurethane form which is obtained after chemical reaction of mixing of isocyanate and polyol. Besides, suspension 1*a* may be formed by vulcanizing unvulcanized compositions such as NBR, SBR or EPDM, which are pliable material, using heat press. Using suspension 1*a* discussed above, deformation can be prevented and a linearity of compliance can be obtained.

According to the first embodiment, suspension 1*a* is coupled with diaphragm 6, however, suspension 1*a* may be fixed to voice coil 10.

Furthermore, according to the first embodiment, roll section 1*b* is formed based on a straight line connecting two points on an outer periphery, however, roll section 1*b* may be formed based on a straight line connecting two points on an inner periphery.

Second Exemplary Embodiment

The second exemplary embodiment of suspension device 20 of the present invention is demonstrated hereinafter with reference to FIGS. 6A and 6B.

Figure 6A:
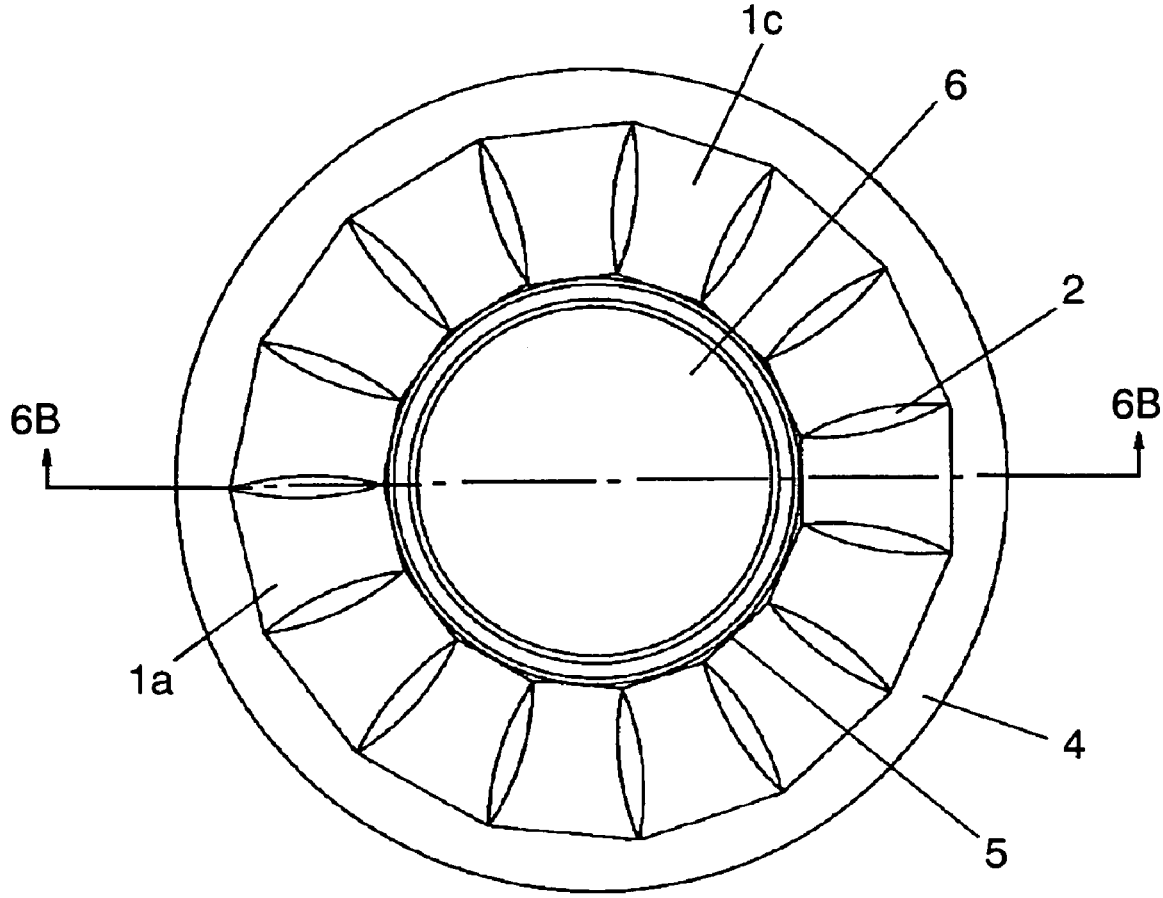
FIG. 6A is a plan view of a suspension device in accordance with a second exemplary embodiment of the present invention.
Figure 6B:
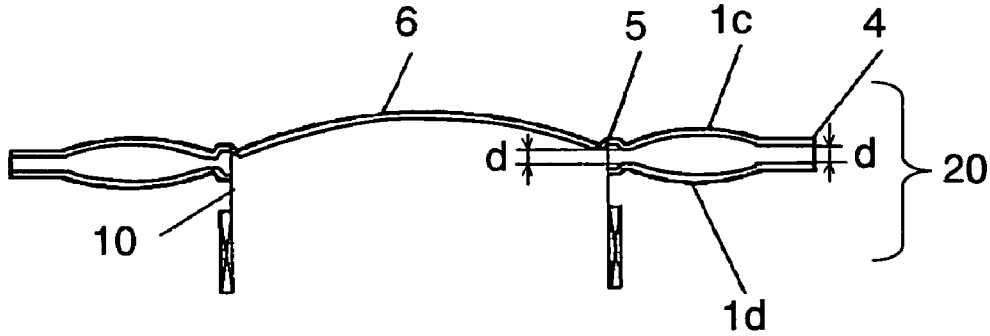
FIG. 6B is a sectional view of the suspension device of FIG. 6A taken along the line 6B-6B in accordance with the second exemplary embodiment of the present invention.

FIG. 6A is a plan view of suspension device 20 in accordance with the second exemplary embodiment of the present invention. FIG. 6B is a sectional view of FIG. 6A taken along the line 6B-6B.

Only different point between the first embodiment and the second embodiment is described hereinafter with reference to FIGS. 6A and 6B. Suspensions 1*c* and 1*d* each have the same shape as suspension 1*a*, and are fixed to voice coil 10. Suspension 1*c* is placed above suspension 1*d* at a certain distance. Suspension device 20 has suspensions 1*c* and 1*d*. Suspension 1*c* may be fixed to or integrally molded with diaphragm 6.

Third Exemplary Embodiment

The third exemplary embodiment of suspension device 20 of the present invention is demonstrated hereinafter with reference to FIGS. 7A and 7B.

Figure 7A:
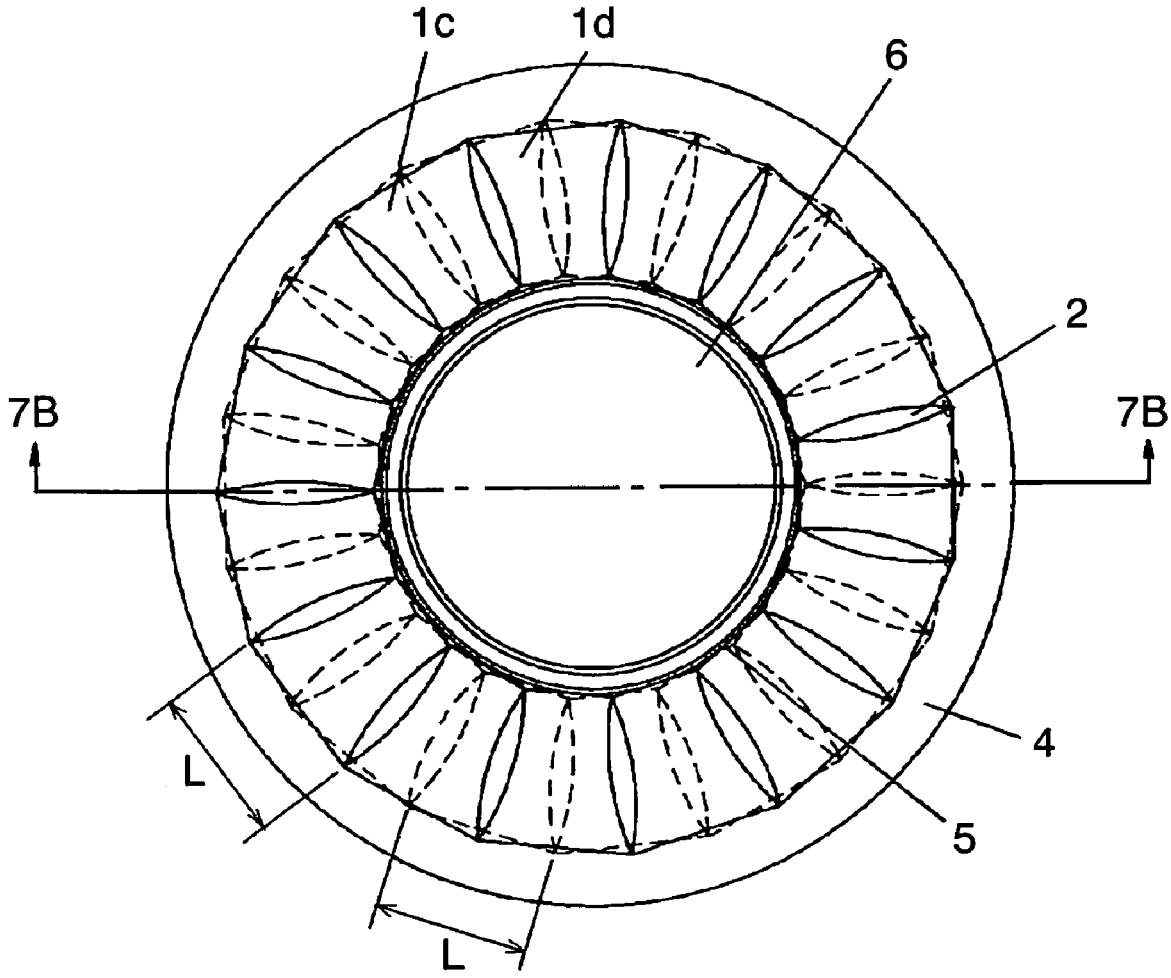
FIG. 7A is a plan view of a suspension device in accordance with a third exemplary embodiment of the present invention.
Figure 7B:
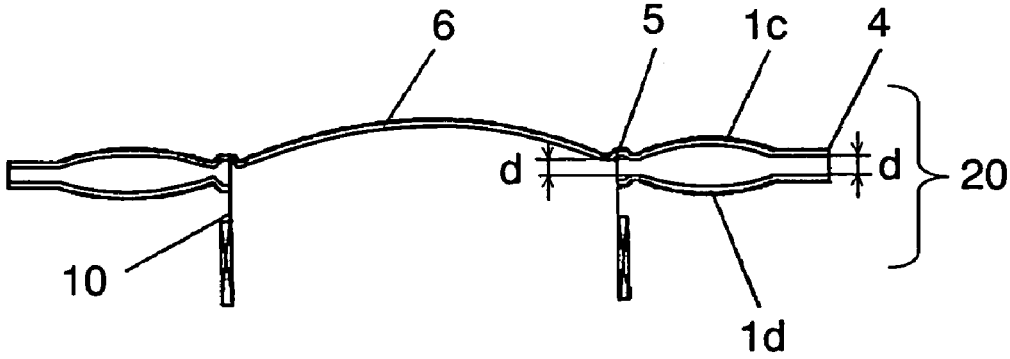
FIG. 7B is a sectional view of the suspension device of FIG. 7A taken along the line 7B-7B in accordance with the third exemplary embodiment of the present invention.

FIG. 7A is a plan view of suspension device 20 in accordance with the third exemplary embodiment of the present invention. FIG. 7B is a sectional view of FIG. 7A taken along the line 7B-7B. Suspension device 20 has suspensions 1*c* and 1*d*. Suspensions 1*c* and 1*d* each have the same shape as suspension 1*a*, and suspension 1*c* is shifted from suspension 1*d* by approximately ½ of width "L" of the roll section in a rotating direction (i.e., a periphery direction).

In other words, suspensions 1*c* and 1*d* are disposed in a substantially vertical direction, and one of suspensions 1*c* and 1*d* is rotated by ½ of a width of the roll section with respect to an axis in the periphery direction. Generation of rolling in driving can be prevented when the suspension is mounted in an electro-acoustic transducer.

Suspensions 1*c* and 1*d* are fixed to voice coil 10 and spaced each other. Suspension 1*c* may have the same direction as suspension 1*d* or have a reverse direction of suspension 1*d*. Using the structure discussed above, rigidity of suspension device 20 increases and rolling is further prevented.

According to the second and third embodiments, upper suspension 1*c* is fixed to the diaphragm, however, suspension 1*c* may be coupled with voice coil 10.

In addition, rolling is further prevented by widening interval "d" between suspensions 1*c* and 1*d*.

INDUSTRIAL APPLICABILITY

The present invention provides a suspension where stress generated at its inside in a circumference direction is individually divided. Using this structure, a superior linearity of compliance can be obtained, distortion which affects acoustic characteristics can be reduced and rolling caused by deformation can be restricted. As a result, the suspension which is suitable for large amplitude and has supporting functions can be obtained. Therefore, an electro-acoustic transducer which can expand low-tone-reproducing bands by reducing a minimum resonance frequency is provided, even when it is structured with the same width as a conventional one.

The invention claimed is:

1. A suspension device for spanning between an inner member and an outer member arranged outwardly of the inner member, said suspension device comprising:

a plurality of roll sections configured to span between the inner member and the outer member and being arranged in a loop; and a plurality of boundary sections, each of said boundary sections being arranged between an adjacent pair of said roll sections, such that said roll sections and said boundary sections are arranged so as to form a continuously alternating pattern of said roll sections and said boundary sections, wherein the continuously alternating pattern of said roll sections and said boundary sections forms a continuous closed loop having a continuous surface, wherein each of said roll sections includes an inner-connecting edge configured to connect to the inner member and an outer-connecting edge configured to connect to the outer member, wherein said roll sections are circumferentially arranged in a continuous closed loop, wherein each of said roll sections constitutes a semi-cylindrical curved surface spanning from said inner-connecting edge to said outer-connecting edge, and wherein for each of said roll sections, at least one of said inner-connecting edge and said outer-connecting edge constitutes a straight edge, said straight edges of said roll sections together forming the continuous closed loop.

2. The suspension device of claim 1, wherein said roll sections are arranged at regular intervals.

3. The suspension device of claim 1, further comprising:

a frame attaching part connected to a continuous outer loop formed by said outer-connecting edges of said roll sections, said frame attaching part being configured to connect to a frame, wherein any non-continuous parts of said inner-connecting edges of said roll sections are trimmed.

4. The suspension device of claim 1, further comprising:

a vibration system attaching part connected to a continuous inner loop formed by said inner-connecting edges of said roll sections, said vibration system attaching part being configured to connect to a diaphragm or a voice coil, wherein any non-continuous parts of said outer-connecting edges of said roll sections are trimmed.

5. The suspension device of claim 1, wherein said plurality of roll sections is constituted by an odd number of said roll sections.

6. A device comprising first and second suspension devices arranged in a covering relation with respect to each other, each of said first and second suspension devices being constituted by the suspension device of claim 1.

7. A device comprising first and second suspension devices arranged in a covering relation with respect to each other, each of said first and second suspension devices being constituted by the suspension device of claim 1, and wherein said first and second suspension devices are circumferentially offset relative to one another by ½ of a width of one of said roll sections.

8. An electro-acoustic transducer comprising:

the suspension device of claim 1, wherein said inner-connecting edges of said roll sections are coupled with a voice coil disposed in a magnetic gap of a magnetic circuit or with an outer peripheral part of a diaphragm coupled with said voice coil, and wherein a frame attaching part is connected to a continuous outer loop formed by said outer-connecting edges of said roll sections, said frame attaching part for supporting the magnetic circuit and a vibration system.

9. The suspension device of claim 2, further comprising:

a frame attaching part connected to a continuous outer loop formed by said outer-connecting edges of said roll sections, said frame attaching part being configured to connect to a frame, wherein any non-continuous parts of said inner-connecting edges of said roll sections are trimmed.

10. The suspension device of claim 2, further comprising:

a vibration system attaching part connected to a continuous-inner loop formed by said inner-connecting edges of said roll sections, said vibration system attaching part being configured to connect to a diaphragm or a voice coil, wherein any non-continuous parts of said inner-connecting edges of said roll sections are trimmed.

11. The suspension device of claim 2, wherein said plurality of roll sections is constituted by an odd number of said roll sections.

12. A device comprising first and second suspension devices arranged in a covering relation with respect to each other, each of said first and second suspension devices being constituted by the suspension device of claim 2.

13. A device comprising first and second suspension devices arranged in a covering relation with respect to each other, each of said first and second suspension devices being constituted by the suspension device of claim 2, and wherein said first and second suspension devices are circumferentially offset relative to one another by ½ of a width of one of said roll sections.

14. An electro-acoustic transducer comprising:

the suspension device of claim 2, wherein said inner-connecting edges of said roll sections are coupled with a voice coil disposed in a magnetic gap of a magnetic circuit or with an outer peripheral part of a diaphragm coupled with said voice coil, and wherein a frame attaching part is connected to a continuous outer loop formed by said outer-connecting edges of said roll sections, said frame attaching part for supporting the magnetic circuit and a vibration system.

* * * * *